US007449671B2

(12) United States Patent
Asikainen et al.

(10) Patent No.: US 7,449,671 B2
(45) Date of Patent: Nov. 11, 2008

(54) METHOD AND APPARATUS FOR REELING CONTROL HAVING AN ELECTROMAGNETIC RADIATION DETECTION

(75) Inventors: Petri Asikainen, Järvenpää (FI); Marko Tiilikainen, Kellokoski (FI); Toni Heikkilä, Kotka (FI); Petteri Lannes, Jokela (FI); Tatu Pitkänen, Järvenpää (FI); Marko Rintanen, Espoo (FI); Petri Enwald, Tuusula (FI)

(73) Assignee: Metso Paper, Inc., Helsinki (FI)

( * ) Notice: Subject to any disclaimer, the term of this patent is extended or adjusted under 35 U.S.C. 154(b) by 282 days.

(21) Appl. No.: 10/599,710

(22) PCT Filed: Apr. 5, 2005

(86) PCT No.: PCT/FI2005/050110

§ 371 (c)(1),
(2), (4) Date: Oct. 5, 2006

(87) PCT Pub. No.: WO2005/097646

PCT Pub. Date: Oct. 20, 2005

(65) Prior Publication Data

US 2007/0176040 A1 Aug. 2, 2007

(30) Foreign Application Priority Data

Apr. 7, 2004 (FI) ..... 20040510

(51) Int. Cl.
*H01J 40/14* (2006.01)

(52) U.S. Cl. ..... 250/221; 250/559.36

(58) Field of Classification Search ..... 250/221, 250/559.36, 559.4; 242/534, 541.1, 532.3, 242/533, 541.6, 542.3; 356/238.1, 238.2
See application file for complete search history.

(56) References Cited

U.S. PATENT DOCUMENTS

| | | | |
|---|---|---|---|
| 4,128,212 | A | 12/1978 | Birch |
| 5,531,396 | A | 7/1996 | Kinnunen et al. |
| 5,820,065 | A | 10/1998 | Altosaar et al. |
| 5,971,315 | A | 10/1999 | Kojo |
| 6,036,137 | A | 3/2000 | Myren |

(Continued)

FOREIGN PATENT DOCUMENTS

CA 2483818 A1 3/2003

(Continued)

OTHER PUBLICATIONS

Written Opinion of the International Searching Authority issued in PCT/FI2005/050110.

(Continued)

*Primary Examiner*—Que T Le
(74) *Attorney, Agent, or Firm*—Stiennon & Stiennon

(57) ABSTRACT

In a method and an apparatus for controlling reeling used in connection with the making of paper/board/some equivalent web-like material, a reeler is used in the reeling which has a reeling element (2), a reeling core (T), around which the web (W) is reeled to form a reel (3), as well as elements for loading the reeling core (T) and the reeling element (2) against each other in order to bring about a reeling nip (N) in between the reeling element (2) and the reel (3). The reeling is monitored by a detection apparatus, which automatically detects any events differing from normal reeling.

24 Claims, 5 Drawing Sheets

U.S. PATENT DOCUMENTS

| | | | | |
|---|---|---|---|---|
| 6,390,408 | B1 * | 5/2002 | Madrzak et al. | 242/541.6 |
| 2003/0029959 | A1 | 2/2003 | Fujiwara et al. | |

FOREIGN PATENT DOCUMENTS

| | | | |
|---|---|---|---|
| DE | 10218509 | A1 | 11/2003 |
| EP | 1084976 | A2 | 3/2001 |
| FI | 94231 | B | 4/1995 |
| FI | 107327 | B | 7/2001 |
| FI | 108635 | B | 2/2002 |
| WO | 99/62804 | A1 | 12/1999 |
| WO | 03/076320 | A1 | 9/2003 |
| WO | 2005/097646 | A1 | 10/2005 |

OTHER PUBLICATIONS

Search Report issued in PCT/FI2005/050110.
Search Report issued in FI 20040510.
English translation of Abstract in EP 1084976.

* cited by examiner

METHOD AND APPARATUS FOR REELING CONTROL HAVING AN ELECTROMAGNETIC RADIATION DETECTION

CROSS REFERENCES TO RELATED APPLICATIONS

This application is a U.S. national stage application of International App. No. PCT/FI2005/050110, filed Apr. 5, 2005, and claims priority on Finnish App. No. 20040510, filed Apr. 7, 2004, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention concerns a method and apparatus for controlling reeling used in connection with the making of paper/board/an equivalent web-like material, in which reeling a reeler is used, which comprises a reeling element, a reeling core, around which the web is reeled to form a reel, as well as elements for loading the reeling core and the reeling element against each other in order to bring about a reeling nip in between the reeling element and the reel.

The invention relates generally to the making of paper, tissue or board or some other equivalent web-like product and to the associated reeling. When referring hereinafter to a papermaking machine or to paper, such reference also includes a machine intended for making the above-mentioned products or the product to be made by it.

The finished paper web of a papermaking machine or other device processing a web-like product is reeled around a roll in a reeler located at the end of the machine, which is called a reeling drum. The reel formed around the roll from the paper web of full width emerging from the machine is called a machine reel. In the reeling device, that is, in the reeler, a reeling cylinder rotates at a peripheral speed equal to the speed of the paper web. The reeling cylinder is bearing-mounted in the body of the reeling device with the aid of shafts located at its ends. At its one end the reeling cylinder is connected to a driving device, which for its part is in connection with the overall drive of the machine in such a way that the reeling cylinder's peripheral speed is equal to the speed of the completed paper web emerging from the machine. This type of reeler goes under the name of Pope reeler. Besides the reeling cylinder, a reeling belt may also be used in the reeler, which belt is known from the patent FI-94231 of Metso Paper, Inc.

The finished web is collected on a reeling drum located at the reeling station, while the drum is loaded at the same time towards the reeling cylinder. The reeling drum may have its motional power with the aid of friction through the paper web from the reeling cylinder (a so-called peripherally driven Pope reeler) or according to a solution in general use today, it can be provided with a drive, whereby the reeler is called a center-driven reeler.

When a sufficient quantity of paper web has accumulated on the reeling drum, the reel is dismounted from the surface of the reeling cylinder. The reel's peripheral speed will decrease as the reel is slowed down, and a bag will form in the web before the reeling drum, which bag is guided with the aid of an airflow and placed around a new empty reeling drum brought to the reeling cylinder. The paper web moving on to a full reeling drum will break off immediately and it starts winding around the new reeling drum. Other alternative ways are also used, and they depend on the basis weight of the paper, among other things.

In connection with the reeling, especially with today's high and constantly increasing speeds, an over-pressure occurs in the inlet jaw between the web and the reeling cylinder, in consequence of which an excessive quantity of air will penetrate in an undesirable manner between the reeling cylinder and the arriving paper web. This problem occurs especially in broad machines operating at high speeds and it is especially harmful with paper grades poorly permeable to air (with grades calendered on line in particular).

The forming air bag, which is located just before the reeling nip between the reeling cylinder and the reel, makes air penetrate between the paper layers, whereby smaller air bags will form especially between the topmost layers. The phenomenon is illustrated in the appended FIG. 1B, which shows air bags b forming in the reel in spaces between the topmost paper layers $P_1$, $P_2$, $P_3$, $P_4$. The air can only escape from the ends of the reel, whereby air will collect in the reel's middle parts in particular. This causes several various problems, such as folding, looseness in the reel structure and various flaws in the paper quality. The phenomenon can occur, for example, as a star pattern visible at the end of the reel. The quality problems resulting in this manner will for their part give rise to an increasing quantity of rejects in the production.

An attempt to solve the airbag problem is made, for example, by a solution presented in the printed patent specification FI 107327, wherein the reeling cylinder is grooved to conduct the air away in a controlled manner from the reeling nip.

Another problem occurring in connection with reeling relates to cross-cutting of the paper web in connection with the reel change. Irrespective of the cross-cutting method used, the problem in connection with cross-cutting is the occurrence of loose pieces of paper, that is, fodder, and their ending up inside the material to be reeled. If in connection with unreeling fodder drifts to the following process stage, typically in connection with the calendering on to rolls, then damages may result, which must be corrected at high costs. The calenderer's roll coatings in particular are easily damaged by the impact of superfluous particles.

According to the state of the art, attempts have been made to solve said fodder problem by leaving a sufficient quantity unused of the reel's final part in connection with the unreeling. The idea is to make sure in this manner that no fodder will occur in the part of the reel intended for use. However, the consequence is a loss of material, since an unnecessarily large quantity of paper is often rejected just to be sure.

Of the problematic situations occurring with the reeler such a situation may also be mentioned, where at least a double folding has formed in the edge of the paper web or equivalent and such a double part begins assembling in the reel. As the reel is growing, the nip will draw in this double area only, but not in the other part of the reel. The occurrence of a double edge may be caused, for example, by flapping of the edge, which may result from a too high running speed, profile problems in the web, breaking of the edge or quality flaws occurring in connection with the calendering, such as a sharp fold in the paper.

As the size of the roll is growing, a double edge will cause mechanical tensions in the reel. The mechanical tension is released when the paper layers in the reel yield, and in this way a situation arises where the reel disintegrates. Disintegration may even take place explosively, whereby pieces weighing 0.5-5 kilos may hurl out of the disintegrating reel into the environment. The hurling reel pieces cause a hazardous situation for people nearby. They may also cause mechanical damage to equipment nearby.

Furthermore, such a problematic situation occurs in connection with reeling, where the paper web piles up or folds up on the reel bottom in connection with the reel change, and a situation where the web does not move on to the reel but drifts around the reeling cylinder or elsewhere near the reeler. In addition, the web may have split up in the machine direction before the reeling, and this will lead to quality problems in the reeling. At times when the edges of a split web have overlapped, the split web is not necessarily detected by the state-of-the-art devices observing holes occurring in the web.

SUMMARY OF THE INVENTION

The invention aims at providing a method and device in connection with reeling for significantly reducing the problems presented above.

The invention aims at providing a method and device in connection with reeling for automatic detection of problematic situations occurring in reeling.

The invention aims at providing a method and device in connection with reeling for automatic correction of problematic situations occurring in reeling.

The method according to the invention is characterized in that reeling is monitored by a detection apparatus, which automatically detects events differing from normal reeling.

The apparatus according to the invention for its part is characterized in that the apparatus comprises means for automatic detection of situations differing from normal reeling.

According to the invention, the area in between the reeling cylinder and the reel is observed by a measuring device in order to detect reeling errors, that is, an airbag and/or loose pieces of paper and/or a double edge and/or piling up of the web and/or a split web. The observing is done by a detection apparatus comprising a monitoring device, preferably a camera or a distance-measuring laser, as well as a data processing unit, and various computer vision methods and related pattern recognition methods are utilized in the observing.

When observing airbags occurring in the reeling area, the dimensions permissible for airbags are determined and when these are exceeded steps are taken in order to diminish the airbag. The measured information obtained from the apparatuses for airbag detection is used for controlling the airbag by controlling the reeling parameters, such as the linear load, the web tension or the peripheral force.

Correspondingly, loose pieces of paper occurring in connection with the reeling are observed by the detection apparatus. The information on loose pieces of paper detected by the monitoring device according to the invention is supplied, for example, to a measuring unit used for determination of the reel size, which registers that place in the reel where fodder occurs. Based on this information, exact information is obtained on how big a part of the beginning of the reel has to be rejected.

For its part, detection of a double edge or a web split in the machine direction by the detection apparatus according to the invention results in an interruption of the reeling, until the fault has been corrected, or in a reel change. With the apparatus according to the invention such a situation is also detected, where the web does not end up in the reel but starts winding around the reeling cylinder or drifts to some other wrong place. When this occurs, the reeling must be interrupted. An interruption of the reeling results in a signal being given to the web-break monitoring, whereby the web will be run as reject from a suitable shutdown point.

With the automatic monitoring of the reeling area according to the invention one avoids the exhausting monitoring by human eyes of the reeling area, and prompter control or correction measures can also be taken when problems occur. For example, when an airbag occurs, the dimensions of the forming airbag can automatically be kept within permissible limits by using the feedback adjustment according to the invention. Steps can be taken quickly to deal with other problems noticed and the situation can be restored to normal. With papermaking machines, better runnability and a higher running speed are hereby achieved, among other things.

By using the method and apparatus according to the invention the quantity of resulting rejects can be reduced significantly. In consequence of this, cost savings are achieved and the drawbacks caused by interruptions in the production are reduced.

The apparatus according to the invention for controlling reeling can be implemented as a modular system, which can easily be installed as a retrofit even in old papermaking machines or finishing machines.

The method and apparatus according to the invention can be applied in all reeling devices used in papermaking, which are, for example, a papermaking machine's/tissue-making machine's/board-making machine's continuously working reeler, an intermediate reeler, a calender's in-reeler, a coating machine's reeler and a slitter's reeling part.

The invention will be described in greater detail in the following by referring to the appended figures.

DESCRIPTION OF THE PREFERRED EMBODIMENTS

Figure 1A:
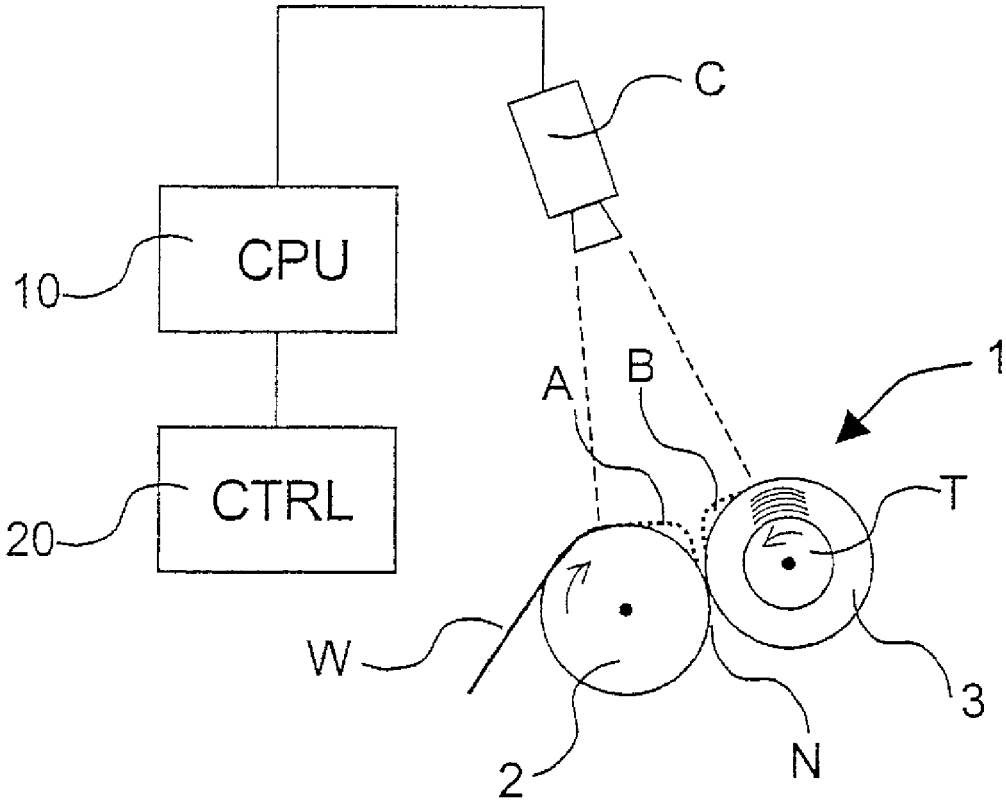
FIG. 1A illustrates airbags occurring in the reeling area and it presents a first way of measurement for observing the reeling area.
Figure 1B:
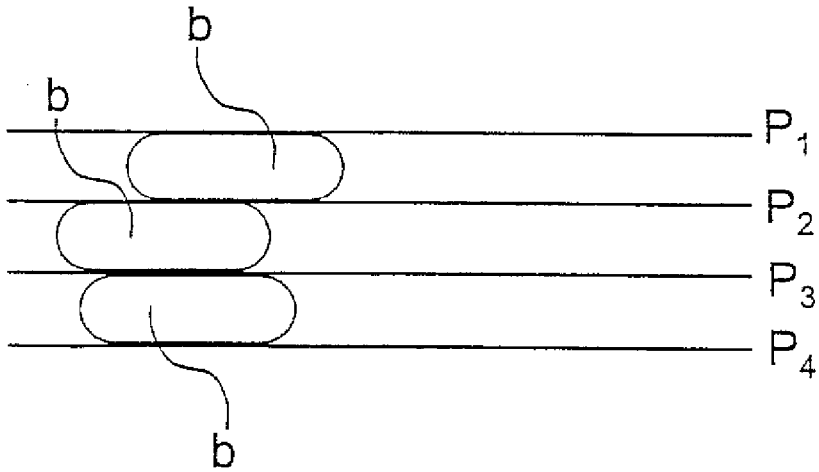
FIG. 1B presents airbags occurring in between paper layers.

FIG. 1A shows a first way of measurement for observing a reeling area. In this embodiment, the measured object is especially the detection of airbags occurring near the reeling nip. FIG. 1A is a schematic view of a papermaking machine's reeler 1 comprising a reeling element, preferably a reeling cylinder 2 and a reeling core, such as a reeling drum T or a reel 3 formed around a reel core. The paper web W is guided through the reeling cylinder 2 on to the reel 3. An arrow drawn into the reeling cylinder 2 indicates the reeling cylinder's 2 direction of rotation and an arrow drawn into the reeling core T indicates the reeling core's T direction of rotation. Differing from this presentation, it is also possible as the reeling element to use the reeling wire presented in the Metso Paper, Inc. FI-94231 patent.

In connection with reeling cylinder 2 beside the nip N an airbag A has formed, and an airbag B has formed atop the reel 3 beside the nip N. The reeling area is observed in order to detect airbags by an apparatus, which in this embodiment comprises a camera C functioning as the monitoring device, and connected to it in data communication connection a data processing unit 10. In FIG. 1A, the area observed by the camera C is delimited by dashed lines. The area under observation is chosen by adjusting the camera's characteristics (the focal distance, the distance between the camera and the target, zooming, etc.) in such a way that both airbags A, B will be visible in the pictures taken by the camera C. It is advantageous to illuminate the reeling area by a light source (not shown in FIG. 1A) and the direction of incidence of the light is chosen so that any abnormal phenomena observed in the reeling area will show in a pronounced manner. When observing airbags or other objects slightly raised from the web, the direction of light incidence is preferably adjusted to be almost in parallel with the web, whereby the shadows of observed objects will show as clearly as possible. Electromagnetic radiation is used as the light source, preferably a source producing a visible or an invisible light.

The camera C for use in the different embodiments of the present invention may be a line camera, digital camera, video camera or some other scanner suitable for computer vision applications and applicable to observation of a reeling area. The camera C is a scanner detecting electromagnetic radiation, preferably visible or invisible light. From the camera C the information is transmitted as a suitable signal, for example, as a video signal when using a video camera, to the data processing unit 10, which will determine the airbag's dimension or a sudden change of the situation. The data processing unit 10 is a functional unit comprising the processor and memory capacity necessary for the invention. It may be a separate unit or a part of an available information system and it has the required data transmission connections with other systems, such as the monitoring systems of a papermaking machine.

From the data processing unit 10 the control information is transmitted to the control unit 20 for reeling parameters used for controlling the reeling parameters. The control unit 20 for reeling parameters is a functional unit, which may be implemented, for example, as a part of a reeling control unit. Controlled reeling parameters are, for example, one or more parameters from the following set of control targets: linear load, web tension, peripheral force, profiling electrostatic nip, air pressure device, profiling nip roll or running speed.

Figure 2:
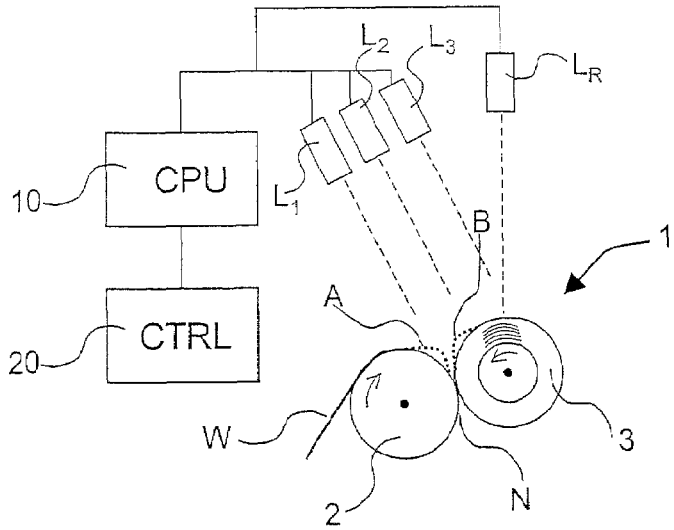
FIG. 2 shows another way of measurement for observing the reeling area.

FIG. 2 shows another way of measurement for detecting airbags. In the embodiment shown in FIG. 2, the reeling area is observed by an apparatus comprising distance-measuring lasers $L_1$, $L_2$, $L_3$, of which there are three in this example, but the number of which can also be different from the number presented here. The distance-measuring lasers $L_1$, $L_2$, $L_3$ give information on changes in the reel size at the point where the airbag occurs. The size of the reel 3 is also constantly observed by a reference-measuring laser $L_R$, which is directed at such a place, where airbags do not occur and which thus gives exact reference information on the reel size. The size of the airbag B formed on the reel is determined by subtracting the distance information given by the reference laser $L_R$ from the measurement information of lasers $L_1$, $L_2$, $L_3$. The measured distance information is taken to the data processing unit 10, which processes the information and which when required, upon detecting an exceptional situation, gives a control signal to the control unit 20 for reeling parameters.

Figure 3A:
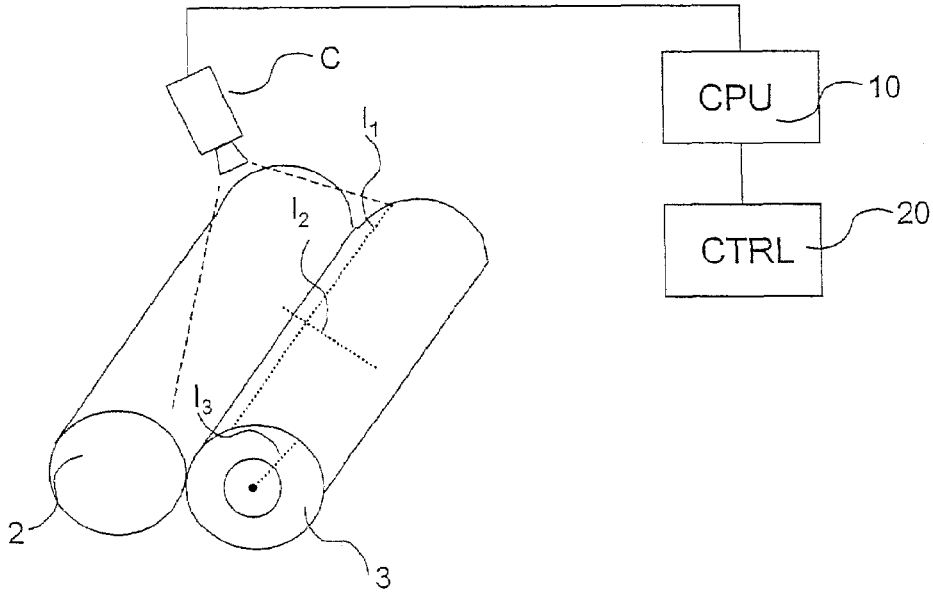
FIG. 3A shows a third way of measurement for observing the reeling area.

FIG. 3A shows a third way of measuring for observing a reeling area. FIG. 3A shows an embodiment according to the invention, wherein the detecting apparatus comprises means (not shown) for bringing about one or more laser lines as well as one or more cameras C for picturing the laser line/lines. According to the invention, the laser line $l_1$ is directed at the reel surface in a transverse direction and the shape of the laser line $l_1$ is observed on the picture taken by the camera C. When an airbag occurs on the reel surface, a change can be seen in the picture taken by the camera C by comparing it with a picture where no airbag is seen. In this manner information is obtained automatically about the occurrence of an airbag.

The shape of the airbag can be determined as different coordinate points, whereby measured points can be stored and descriptors can be drawn of the coordinates. The resulting data can also be read by normal types of control room software, and real-time trends of the bag's shape can be displayed on the control room display. In this manner alarm limits can be established for the displayed data in such a way that as the airbag grows bigger than a certain established limit an alarm will be given to the operating staff, or the reeling parameters will be adjusted automatically. In an embodiment of this kind, no specific software or algorithms need be developed for the processing, but these can be procured as ready-for-use products.

If it is desirable to monitor not only the length of the airbag but also its width at a certain place of the reel, a second laser line $l_2$ can be set crosswise to the former laser line in the machine direction. In addition, FIG. 3A shows a third laser line $l_3$, which is directed at the end of the reel and which can be pictured and used for measuring the size/thickness of the reel. Information relating to the reel size can be utilized, when wishing to store in a memory at which point of the reel the airbag has occurred, and when possibly choosing not to use this part of the reel later in connection with the unreeling.

Figure 3B:
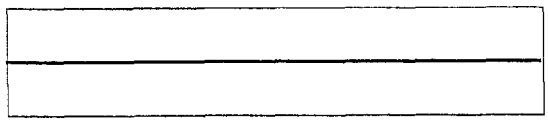
FIG. 3B shows a picture taken by the third way of measurement during a normal reeling process.
Figure 3C:
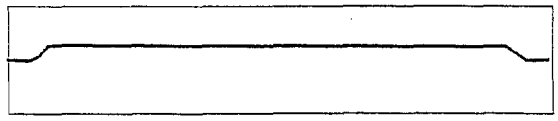
FIG. 3C shows a picture taken by the third way of measurement of an airbag formed in connection with reeling.

FIG. 3B shows a picture taken by camera C on the laser line $l_1$ in a situation where no airbag occurs. The laser line $l_1$ is hereby of a straight shape. Correspondingly, in FIG. 3C a picture has been taken, where an airbag occurs and the shape of the laser line $l_1$ has changed. By having a program compare these pictures an automatic airbag identification system is brought about.

Figure 4:
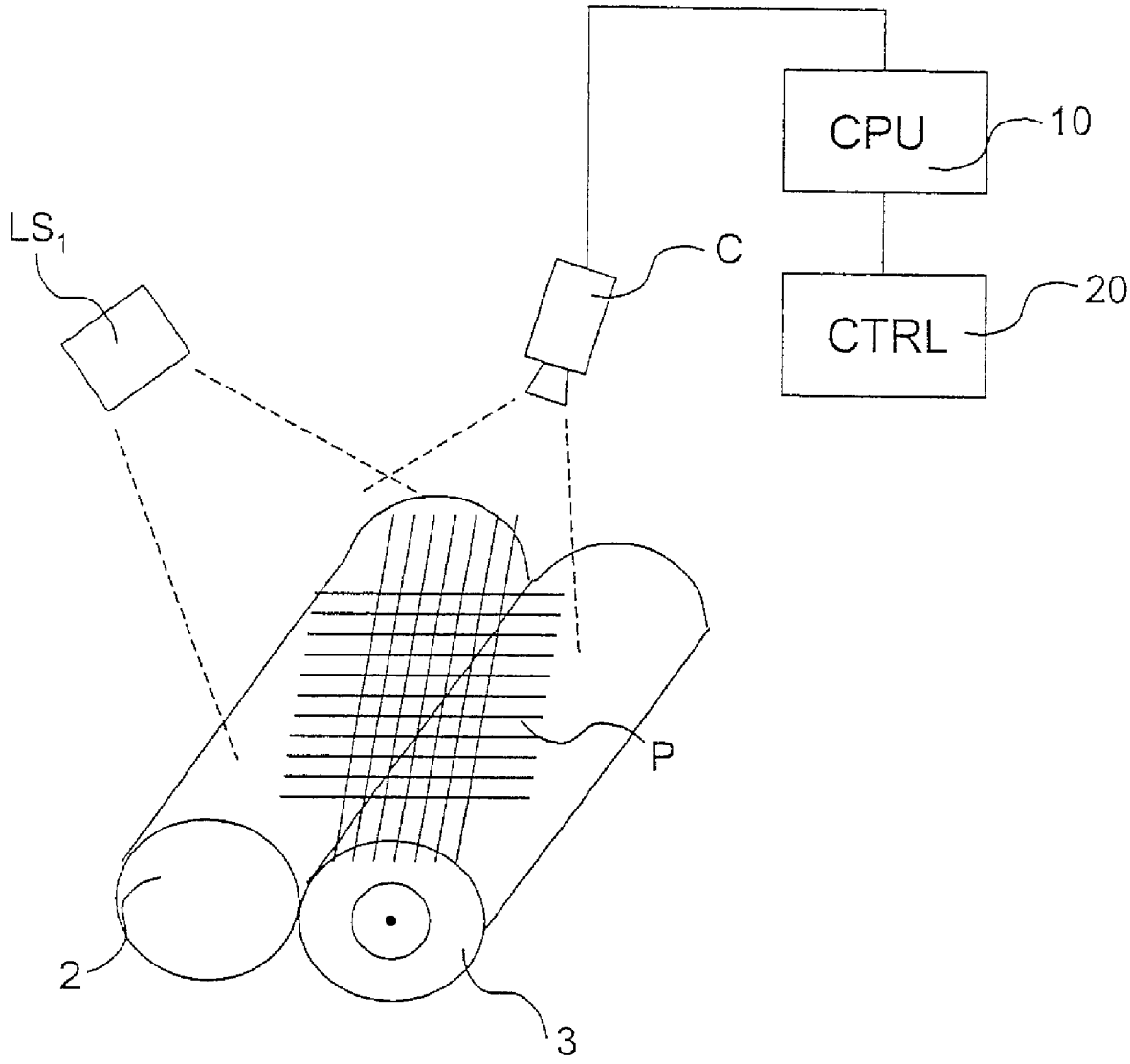
FIG. 4 shows a fourth way of measurement for observing the reeling area.

FIG. 4 shows a fourth way of measurement for observing a reeling area. According to this embodiment, a light pattern is directed at the reeling area to be observed and the light pattern is scanned by a camera. When the reeling situation changes, for example, upon emergence of an airbag, the shape of the light pattern will change and the change is detected optically.

The apparatus according to the fourth way of measurement comprises a light source $LS_1$, a camera C and a data processing unit 10, which is in connection with a control unit 20 for the reeling parameters. The light source $LS_1$ produces a line pattern P to the observed reeling area. The light source $LS_1$ produces electromagnetic radiation, preferably visible or invisible light. The line pattern P can be produced, for example, by a coherent laser light or by some other suitable light source. The line pattern P is preferably a regular line pattern, for example, a line grid, such as is shown in FIG. 4, or some other line pattern, wherein any occurring geometrical changes can be clearly detected, which have occurred upon a change in the web's geometry. The pictures are analyzed in the data processing unit 10, wherein a reference picture is stored of the line pattern P in a situation, where the reeling situation is normal and the web is in an optimum state. The data processing unit 10 compares in real time the pictures taken of the reeling area with the reference picture, and based on this comparison any changed situation will be detected. In the analysis of the line pattern methods of image processing and analysis known as such are utilized. For example, when using a very dense line pattern, it is possible in the analysis to use analyzing methods relating to the so-called Moire's pattern.

Figure 5A:
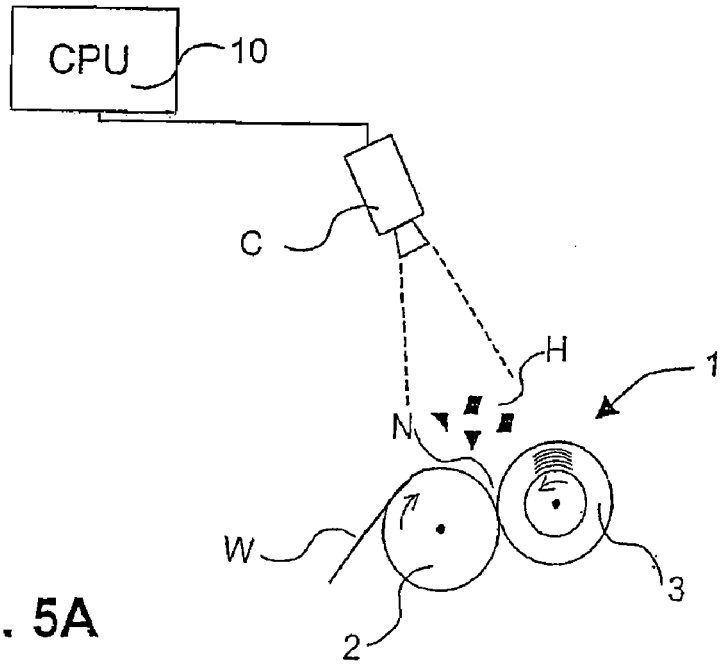
FIG. 5A shows a fifth way of measurement for observing the reeling area.

FIG. 5A shows an embodiment according to the invention, wherein the reeling area is observed from the input side of the in-reeler in order to detect loose pieces of paper, that is, fodder H. FIG. 5A shows an apparatus according to the invention, which is used for monitoring the reeling area from the input side of the nip of the in-reeler. Reeler 1 comprises similar parts as those described in connection with FIG. 1A. The detection apparatus comprises a camera C functioning as the monitoring device and a data processing unit 10. The monitoring device is used to measure changes occurring in the cross machine direction of the web, and the picture area is set so that any loose pieces of paper about to drift through the nip will be detected. The monitoring devices used are, for example, one or more digital cameras, and the camera uses a short shutter time (for example, 1/10 000). When the nip area is well illuminated, any loose pieces of paper moving in the area will stand out clearly and the obtained change information will be taken to the monitoring apparatus. In the detection apparatus a reference picture is stored, where the nip area is trouble-free. The pictures taken during monitoring are compared with the reference picture, and any changes, which may have occurred in the area, are detected automatically with the aid of picture-analyzing software known as such.

Figure 5B:
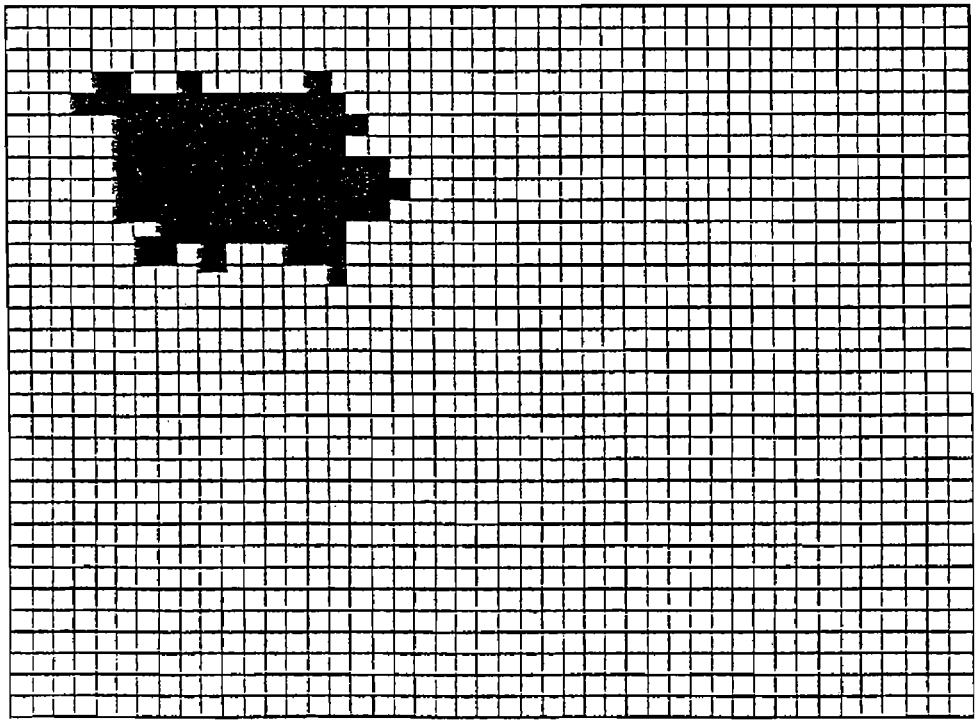
FIG. 5B shows a picture taken by the method of measurement according to FIG. 5A of a loose piece of paper ending up in the reeling area.

FIG. 5B shows an example of a picture taken by a detection apparatus in accordance with the embodiment presented in FIG. 5A, which picture has been processed, for example, by an analyzing program and wherein a loose piece of paper can be seen. When detecting deviations in the pictures, the current reel size at the moment of detection is stored and this information on the reel size is stored. In the following unreeling, this information can be utilized and the concerned part of the reel can be guided for removal of that part (as reject) from the reel, where fodder was found to occur. Alternatively, the concerned part of the reel can be run slower during unreeling. Limit values can be established for the size of deviations in the picture area detected by the camera, whereby very small pieces of paper may be overlooked, if desired. The limit value can be set, for example, by defining a permissible number of pixels, where changes occur in the grey level, or alternatively by defining the duration of the occurring trouble pulse.

Figure 6:
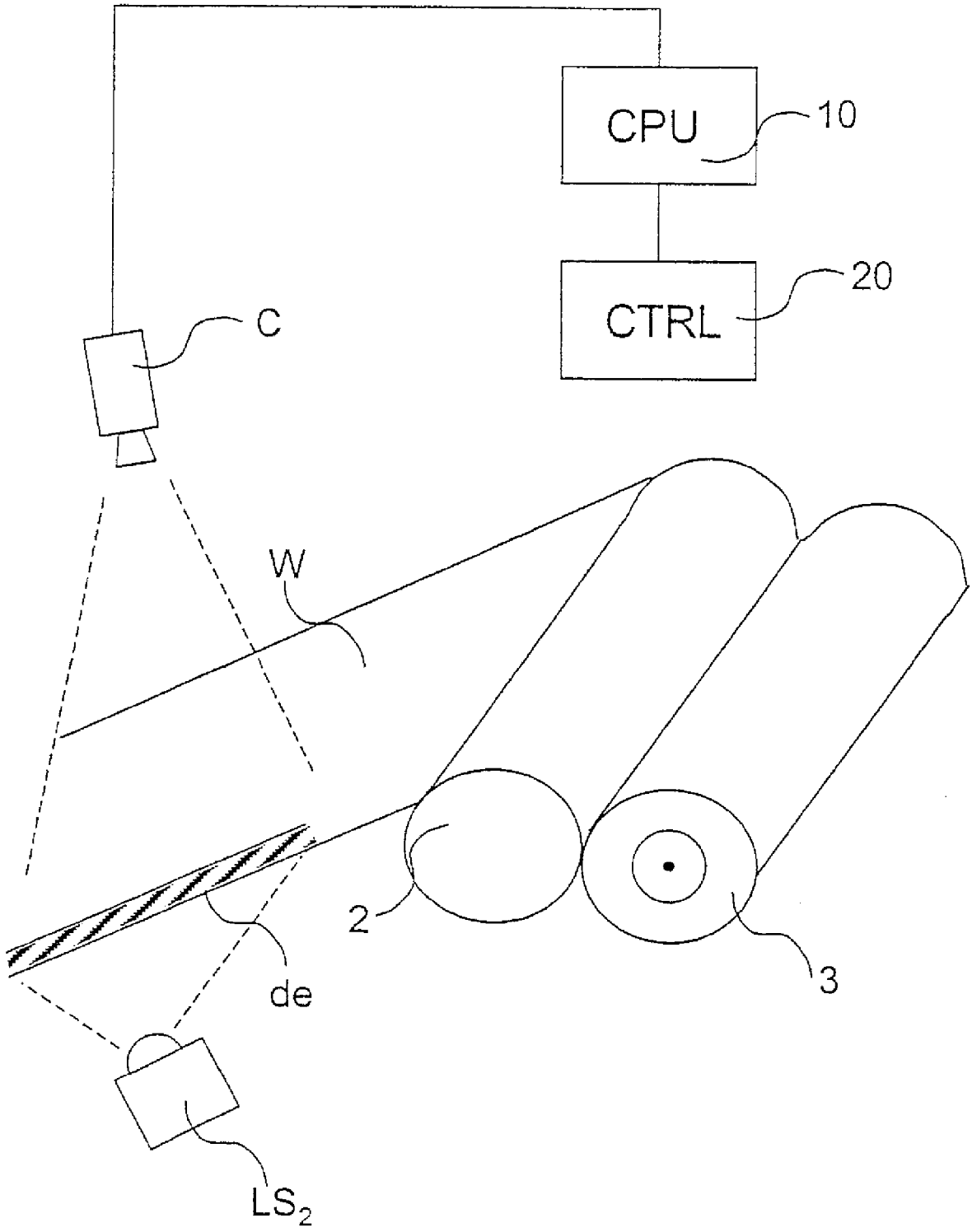
FIG. 6 shows a sixth way of measurement for observing the reeling area.

FIG. 6 shows a sixth way of measurement according to the invention for observation of the reeling area. In this way of measurement, the reeling area is observed in order to recognize a double edge. The web W arriving at the reeling cylinder 2 is lighted by a lighting device $LS_2$ from one side of the web, in this example from below, and the lighted area is pictured by the camera C from the opposite side of the web. The lighting device $LS_2$ produces electromagnetic radiation, preferably visible or invisible light. In the pictures taken by the camera C, the area de occurring at the edge of the web W, where the edge of the web has folded so that it is double, is detected due to the intensity, which is different from the rest of the web. From camera C the picture information is supplied to the data processing unit 10, from which information on the exceptional situation is supplied to the reeler's control unit 20, when required. With this method and apparatus it is also possible to detect other irregularities occurring in the web, such as holes or non-homogeneous areas, which can be seen in the pictures taken by camera C on account of their different intensity.

In the following, claims will be presented, but there is no intention to limit the invention solely to these claims.

The invention claimed is:

1. A method for controlling reeling in a reeler used to wind up a web being made, and traveling in a machine direction, the method comprising the steps of:

winding a web being formed onto a reeling core, to form a reel by directing the web over a reeling element and in to a nip formed between the reeling element and the reel, and loading the reeling core and the reeling element against each other to form the nip;

monitoring the movement of the web into the nip with electromagnetic radiation using at least one device selected from the group consisting of: a line camera, a digital camera, a video camera, a line laser, a distance-measuring laser(s) and a computer vision apparatus; and automatically detecting at least one event deviating from normal reeling, in an area leading in to the nip selected from the group consisting of: an interference in the shape of an airbag, superfluous objects appearing near the reeling nip, loose pieces of paper, or a double web edge, the web drifting into a wrong place, a piling up of the web, and a web split in the machine direction.

2. The method of claim 1, wherein the step of automatically detecting is used to detect loose pieces of paper entering the nip.

3. The method of claim 1, further comprising controlling the reeler automatically in response to the detected event to restore the reeling to a selected state.

4. The method of claim 1, further comprising transmitting a signal in response to the detected event to a web-break monitor and running the web as reject from a shutdown point.

5. The method of claim 1, wherein the step of winding the web is controlled by controlling at least one parameter selected from the group consisting of: a linear load nip load, tension of the web, peripheral force, profiling electrostatic nip, air pressure device, profiling nip roll and running speed.

6. The method of claim 1, wherein loose pieces of paper are automatically detected in an area leading in to the nip to determine that loose pieces of paper are entering the nip and further comprising automatically storing information about where the loose pieces of paper occur within the reel by storing a determined reel size in connection with the determine that loose piece of paper are entering the nip.

7. The method of claim 1, wherein in connection with monitoring the movement of the web into the nip with electromagnetic radiation, the area leading in to the nip is lighted by a light source producing electromagnetic radiation at a direction of incidence, with respect to the area leading in to the nip, such that the electromagnetic radiation is almost in parallel with the web as it approaches the nip so that a distinct shadow is cast by any deviating objects occurring on the web.

8. The method of claim 1, wherein in connection with monitoring the movement of the web into the nip with electromagnetic radiation with the at least one device, a series of images are obtained over time and said images are compared to detect image change over time, wherein the changing part of the image is subjected to a method of pattern recognition for the detection of an airbag.

9. The method of claim 1, wherein in connection with monitoring the movement of the web into the nip with electromagnetic radiation with the at least one device, a series of images are obtained over time and said images are compared to detect image change over time, wherein the changing part of the image is subjected to a method of pattern recognition for the detection of loose pieces of paper.

10. The method of claim 9, wherein a limit value is established for loose pieces of paper, whereby very small pieces of paper are overlooked, the limit value being set by defining a permissible number of pixels where changes occur in grey level.

11. The method of claim 1, wherein in connection with monitoring the movement of the web into the nip with electromagnetic radiation with the at least one device, a series of images are obtained over time and said images are compared to detect image change over time, and wherein the changing part of the image is subjected to a method of pattern recognition for detection of the web drifting into a wrong place.

12. The method of claim 1, wherein in connection with monitoring the movement of the web into the nip with electromagnetic radiation with the at least one device, a series of images are obtained over time and said images are compared to detect image change over time, wherein the changing part of the image is subjected to a method of pattern recognition for the detection of a web split in the machine direction.

13. The method of claim 1, wherein in connection with monitoring the movement of the web into the nip with electromagnetic radiation with the at least one device, a series of images are obtained over time and said images are compared to detect image change over time, wherein the changing part of the image is subjected to a method of pattern recognition for the detection of a double web edge.

14. The method of claim 1, wherein in connection with monitoring the movement of the web into the nip with electromagnetic radiation with the at least one device, a series of images are obtained over time and said images are compared to detect image change over time, wherein the changing part of the image is subjected to a method of pattern recognition for the detection the web winding around the reeling element.

15. The method of claim 1, wherein in connection with monitoring the movement of the web into the nip with electromagnetic radiation with the at least one device a series of images are obtained over time and said images are compared to detect image change over time, wherein the changing part of the image is subjected to a method of pattern recognition for the detection of piling up of the web.

16. A method for controlling reeling in a reeler used to wind up a web being made, the method comprising the steps of:

winding a web being formed onto a reeling core to form a reel by directing the web over a reeling element and in to a nip formed between the reeling element and the reel, and loading the reeling core and reeling element against each other to form the nip; and illuminating a first side of the web as it approaches the reeling element before it moves into the nip with an electromagnetic radiation source which directs electromagnetic radiation at the web from the first side, and using at least one monitoring device to form an image of the web from a second side opposite the first side and the electromagnetic radiation source and to thereby detect any double edge in the web passing to the nip.

17. An apparatus for controlling reeling in a reeler used to wind up a web being made, the apparatus comprising:

a reeling element;

a reeling core, around which the web is reeled to form a reel, the reel forming a nip with the reeling element;

elements for loading the reeling core and the reeling element against each at the nip;

a monitoring device of the type for detecting electromagnetic radiation of a visible or invisible wave length, the monitoring device selected from the group consisting of a line camera, a digital camera, a video camera, a line laser, distance-measuring laser(s), and a computer vision apparatus;

wherein the monitoring device is arranged to view an area leading in to the nip; and a means for automatic detecting in the area leading in to the nip, an airbag, superfluous objects appearing near the nip, a double web edge, a web drifting into a wrong place, piling up of the web, or a web split in the machine direction.

18. The apparatus of claim 17 further comprising means for restoring the reeling to a selected state in connection with the monitoring device.

19. The apparatus of claim 17 further comprising a data processing unit, in image receiving relation with the monitoring device.

20. The apparatus of claim 19 wherein the data processing unit is in connection with a control unit, and the control unit is in controlling relation to means for adjusting reeling parameters.

21. The apparatus of claim 17 wherein the data processing unit is in connection with a control unit and with a means for transmitting a signal to a web-break monitor from the data processing unit.

22. The apparatus of claim 17 further comprising a line pattern generating light source arranged to project a line pattern on the area leading in to the nip.

23. The apparatus of claim 17 further comprising means for illuminating the area leading in to the nip by electromagnetic radiation.

24. The apparatus of claim 17 further comprising a light source arranged to illuminate the area leading in to the nip such that light almost parallel with the web as it approaches the nip is arranged to cast a distinct shadow of any deviating objects occurring on the web.

* * * * *